United States Patent [19]

Blykharov

[11] Patent Number: 4,847,996

[45] Date of Patent: Jul. 18, 1989

[54] DEVICE FOR FACILITATING CLEANING OF ROTARY RAZOR, AND ROTARY RAZOR PROVIDED THEREWITH

[76] Inventor: Ayzik Blykharov, 31-41 23 St. #7N, Astoria, N.Y. 11106

[21] Appl. No.: 60,330

[22] Filed: Jun. 10, 1987

[51] Int. Cl.[4] ..... B26B 19/14

[52] U.S. Cl. ..... 30/41.6; 30/43.6

[58] Field of Search ..... 30/41.6, 43.6, 43, 43.4, 30/43.5

[56] References Cited

U.S. PATENT DOCUMENTS

| | | | |
|---|---|---|---|
| 3,032,873 | 5/1962 | Vaes | 30/41.6 X |
| 3,298,101 | 1/1967 | MacCarthy | 30/41.6 X |
| 4,318,223 | 3/1982 | Bergsma et al. | 30/43.6 |

FOREIGN PATENT DOCUMENTS

| | | | |
|---|---|---|---|
| 0038860 | 3/1979 | Japan | 30/41.6 |
| 0103165 | 8/1979 | Japan | 30/41.6 |

*Primary Examiner*—Douglas D. Watts
*Assistant Examiner*—Michael D. Folkerts

[57] ABSTRACT

A rotary razor is provided with a device for facilitating cleaning, which has a hair supporting plate formed to be arranged in a hair accumulating chamber and to cover its bottom while having passages for passing blade shafts therethrough, and a side wall extending substantially perpendicularly from the hair supporting plate and formed of one piece with it.

2 Claims, 2 Drawing Sheets

DEVICE FOR FACILITATING CLEANING OF ROTARY RAZOR, AND ROTARY RAZOR PROVIDED THEREWITH

BACKGROUND OF THE INVENTION

The present invention relates to a device for facilitating cleaning of a rotary razor, and to a rotary razor provided with the same.

In known rotary razors, cleaning of razors from hair is a very unpleasant operation, and many users do not clean the razor frequently. This leads to premature wear and worsening of shaving efficiency of the razors. The rotary blades form a compact mass of hair inside the razor since the gaps between the blade teeth are small and the quantity of hair thrown into the hair accumulating chamber is lower than the quantity of hair received during shaving. The razor operates insufficiently, quality of shaving suffers, and the blades wear soon and must be replaced. Hair also penetrates into recesses of rotatable shafts, into bushes of the shafts during shaving, as well as during cleaning of the hair accumulating chamber with a brush which pushes a portion of hair into the above mentioned spaces. This leads to a non-uniform rotation of the blades which affects the quality of shaving and service life of the blades. Hair also penetrate into a recess which receives a hinge of the blade supporting plate, and also into a recess which receives a locking element of the latter, which also leads to the premature wear of the hinge and the lock of the razor. It is to be understood that the above listed disadvantages are highly undesirable for proper shaving operation of rotary razors and for their service life.

SUMMARY OF THE INVENTION

Accordingly, it is an object of the present invention to provide a device for facilitating cleaning of a rotary razor, and a rotary razor provided therewith, which simplify the use of the razor, provide its proper operation, increases the service life by protecting respective parts from hair and easy removal of hair produced during shaving.

In keeping with these objects and with others which will become apparent hereinafter, one feature of the preent invention resides, briefly stated, in a device for facilitating cleaning of a rotary razor which has a hair supporting plate arranged to be placed in a hair accumulating chamber and having passages for passing the rotatable shafts for rotary blades, and a one-piece wall laterally projecting from the hair supporting plate at its periphery to form a tray-like hair collecting member. This member collects hair during shaving, prevents its penetration into respective parts of the razor, and can be removed and disposed with the hair accumulated in it. Thus, cleaning of the razor from hair is significantly facilitated.

The invention also deals with a rotary razor which is provided with the above described device for facilitating its cleaning.

The novel features of the present invention are set forth in particular in the appended claims. The invention itself, however both as to its construction and its manner of operation, will be best understood from the following description of a preferred embodiment, which is accompanied by the following drawings.

DESCRIPTION OF A PREFERRED EMBODIMENT

Figure 1:
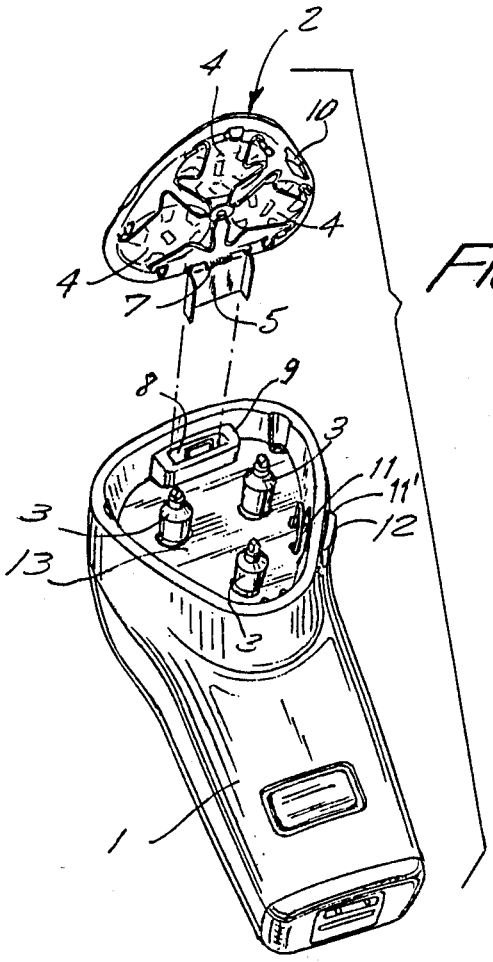
FIG. 1 is a view showing a conventional rotary razor including a main or body part and a blade carrying plate or part.
Figure 2:
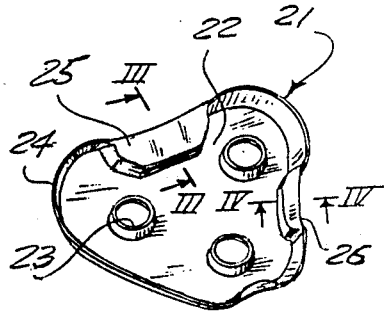
FIG. 2 shows in a perspective a device for facilitating cleaning of the rotary razor, in accordance with the present invention.
Figure 3:
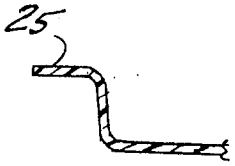
FIG. 3 is a view showing a section taken along the line III—III in FIG. 2, of a part of the inventive device.
Figure 4:
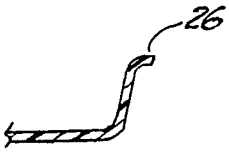
FIG. 4 is a view showing a section taken along the line IV—IV in FIG. 2, of a part of the inventive device.
Figure 5:
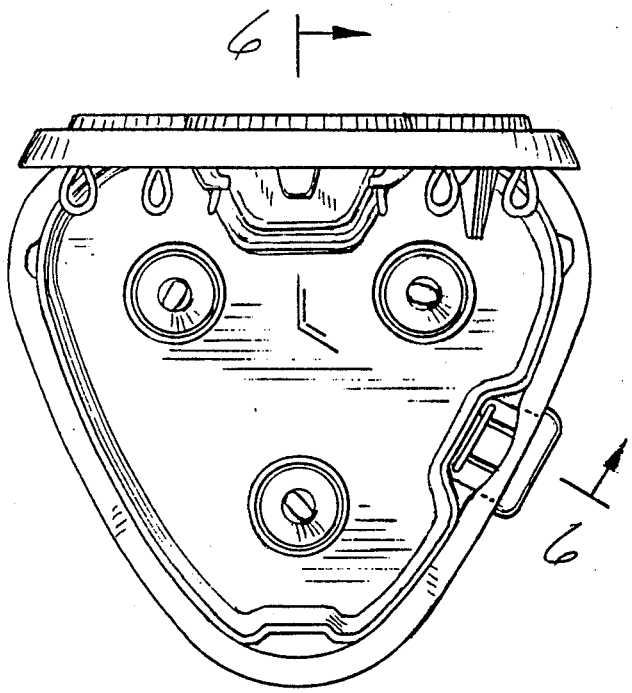
FIG. 5 is a top view of the device for facilitating cleaning a rotary razor in position on the top portion of a conventional rotary razor.
Figure 6:
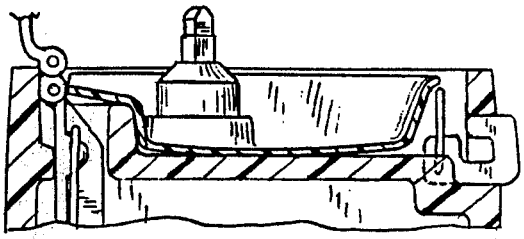
FIG. 6 is a view showing a section taken along the line 6—6 in FIG. 5.

A conventional rotary razor, for which the device for facilitating cleaning in accordance with the present invention is proposed includes a main or body part 1 and a blade carrying part of plate 2, as shown in FIG. 1.

A plurality of rotatable shafts 3 extend from the body part 1 and are drive in rotation by a not shown rotary drive. In the operation position of the razor, when the blade carrying plate is closed and the power is turned on, the shafts 3 engage and rotate shaving blades 4 carried by the plate 2.

The blade carrying plate 2 is turnable relative to the body part 1 by means of a hinge which has a hinge strip 5 turnably connected with the plate 2 and biased by a spring 7. The hinge strip 5 engages in a recess 8 of a strip receiving projection 9 in the body 1. The blade carrying plate 2 is locked to the body 1 by a locking tongue 10 which engages into a recess 11 of a tongue receiving projection 11' in the body 1 and can be released by a push button 12 for opening of the plate 2.

The device for facilitating cleaning is identified as a whole with reference numeral 21. It is formed to be received in a hair accumulating chamber 13 which is provided between a bottom in a depression in the upper surface of the body 1; and a lower surface of the blades 4 and the plate 2 in the closed position of the razor. The device 21 has a hair supporting plate 22 provided with passages 23 for passing of the shafts 3. A side wall 24 extends upwardly from the hair supporting plate 22 and is formed of one-piece with the latter so as to form a tray-like member, for example composed of plastic. When the device 21 is placed into the hair accumulating chamber 13, it is positioned on the bottom of the chamber and the shafts 3 extend through the passages 23 which are formed so that only a minimum play remains therebetween to prevent hair penetration, but allow the rotation of the shafts. A raised portion 25 formed in the device 21 covers partially the strip receiving projection 9 so as to closely embrace the strip 5 and to prevent penetration of hair into the recess 8. Another raised portion 26 extends partially over the tongue receiving projection 11' and closely embraces the tongue 10 so as to prevent penetration of hair into the recess 11.

During shaving, hair which accumulate in the hair accumulating chamber 13 are collected in the tray-like member 21. After shaving, the blade carrying plate 2 is turned from the body part 1, the razor is opened, the tray-like member 21 with the collected hair is removed and disposed. During shaving, it reliably protects respective parts of the razor from hair penetration.

The invention is not limited to the details shown since various modifications and structural changes are possible without departing from the spirit of the present invention.

What is desired to be protected by Letters Patent is set forth in particular in the appended claims.

I claim:

1. A device for facilitating cleaning of a rotary razor which has a plurality of rotary blades with a blade carrying plate, a plurality of rotatable shafts arranged to rotate the rotary blades, a razor body provided with an upper wall extending transversely to the shafts and also with a projection for receiving a hinge strip of the blade carrying plate and with a projection for receiving a locking member, and a hair accumulating chamber formed between the blade carrying plate and above the upper wall, the device comprising a hair supporting plate arranged to be placed between the upper wall of the razor body and the blade carrying plate in the hair accumulating chamber so that hair produced during shaving are deposited not on the upper wall of the razor body but on said hair supporting plate, said hair supporting plate having a plurality of passages through which the rotatable shafts can extend when said hair supporting plate is placed in the hair accumulating chamber on the upper wall of the razor body, said hair supporting plate having a raised portion arranged to extend over the projection for receiving the hinge strip and a further raised portion arranged to extend over the projection for receiving the locking member; and a side wall extending from a periphery of said hair supporting plate over a whole contour of the latter, said hair supporting plate and said side wall being formed of one piece with one another so as to form a tray-like member which is freely insertable and retainable in the hair accumulating chamber and which is freely removable from the hair accumulating chamber and disposable with the hair deposited thereon.

2. A rotary razor, comprising a body provided with a rotary device, a plurality of rotatable shafts driven by said drive, and an upper wall extending transversely to said shafts;

a blade carrying plate with a plurality of rotary blades arranged so that when said blade carrying plate is in a proximal position with said body said blades engage and are rotated by said shafts, and when said blade carrying plate is in a distal position they are disengaged from one another, said upper wall of said body and said blade carrying plate forming a hair accumulating chamber therebetween;

means for hingedly connecting said blade carrying plate with said body and including a hinge strip provided on said blade carrying plate and a projection provides on said body for receiving said hinge strip;

locking means for locking said blade carrying plate and said body with one another and including a locking member provided on said blade carrying plate and a projection for receiving said locking member provided on said body; and means for facilitating cleaning of the razor and including a tray-like member which has a hair supporting plate arranged to be placed between said upper wall of said body and said blade carrying plate in said hair accumulating chamber so that hair produced during shaving are deposited not on said upper wall of said body but on said hair supporting plate, said hair supporting plate having a plurality of passages through which said rotatable shafts extend when said hair supporting plate is placed in said hair accumulating chamber on said upper wall of said body, said hair supporting plate having a raised portion arranged to extend over said projection for receiving said hinge strip and a further raised portion arranged to extend over said projection for receiving said locking member, said tray-like member also having a side wall extending from a periphery of said hair supporting plate over a whole contour of the latter, said hair supporting plate and said side wall being formed of one piece with one another so as to form a tray-like member which is freely insertable and retainable in said hair accumulating chamber and which is freely removable from said hair accumulating chamber and disposable with the hair deposited thereon.

* * * * *